US006749449B2

(12) United States Patent
Mortun et al.

(10) Patent No.: US 6,749,449 B2
(45) Date of Patent: Jun. 15, 2004

(54) SAFETY RECEPTACLE WITH JACKETED INTERNAL SWITCHES

(75) Inventors: Sorin I. Mortun, Irvington, NY (US); Thomas J. Vigorito, Fairfield, CT (US)

(73) Assignee: Hubbell Incorporated, Orange, CT (US)

( * ) Notice: Subject to any disclaimer, the term of this patent is extended or adjusted under 35 U.S.C. 154(b) by 26 days.

(21) Appl. No.: 09/941,743

(22) Filed: Aug. 30, 2001

(65) Prior Publication Data

US 2003/0045145 A1 Mar. 6, 2003

(51) Int. Cl.[7] ..... H01R 29/00
(52) U.S. Cl. ..... 439/188; 200/51.09
(58) Field of Search ..... 439/188; 200/51.09, 200/51.1

(56) References Cited

U.S. PATENT DOCUMENTS

| | | | | |
|---|---|---|---|---|
| 2,540,496 A | | 2/1951 | Sperrazza | 200/51.09 |
| 2,826,652 A | | 3/1958 | Piplack | 200/51.09 |
| 3,617,662 A | | 11/1971 | Miller | 200/51.09 |
| 3,775,726 A | | 11/1973 | Gress | 339/14 |
| 3,990,758 A | | 11/1976 | Petterson | 339/43 |
| 4,148,536 A | | 4/1979 | Petropoulsos et al. | 339/42 |
| 4,271,337 A | | 6/1981 | Barkas | 200/51.09 |
| 4,714,858 A | * | 12/1987 | Sanders | 313/318.07 |
| 5,277,607 A | | 1/1994 | Thumma et al. | 439/188 |
| 5,320,545 A | | 6/1994 | Brothers | 439/188 |
| 5,374,199 A | | 12/1994 | Chung | 439/188 |
| 5,551,884 A | * | 9/1996 | Burkhart, Sr. | 439/140 |
| 5,846,092 A | * | 12/1998 | Feldman et al. | 439/76.1 |
| 6,111,210 A | | 8/2000 | Allison | 200/51.09 |
| 6,299,487 B1 | * | 10/2001 | Lopata et al. | 439/610 |

* cited by examiner

*Primary Examiner*—Ross Gushi
(74) *Attorney, Agent, or Firm*—Jeffrey J. Howell; Alfred N. Goodman

(57) ABSTRACT

An electrical receptacle, including a power source and a contact for making an electrical connection between the power source and a prong of an electrical plug. At least one switch is in series between the contact and the power source, and a smooth member covers at least a portion of the at least one switch. The switch is normally in the closed position and moves in a direction from the closed position to the open position due to a force applied to the smooth member covering at least a portion of the at least one switch by the prong of the electrical plug when the prong of the electrical plug is inserted into the electrical receptacle and contacts the resilient, smooth member.

22 Claims, 5 Drawing Sheets

SAFETY RECEPTACLE WITH JACKETED INTERNAL SWITCHES

FIELD OF THE INVENTION

This invention relates to electrical outlets having improved characteristics of safety and durability. More, specifically, this invention relates to safety receptacle electrical outlets that have jacketed internal switches for improved durability and ease of insertion of an electrical plug.

BACKGROUND OF THE INVENTION

It has been recognized for many years that an electrical outlet can constitute a hazard under certain circumstances and as to certain individuals, notably children, but also adults. Because the conventional outlet normally has two or more energized, electrically conductive contact surfaces, which are rather easily reached through openings in an insulating cover plate, insertion of a pin, scissors or other electrically conductive device can result in serious shock.

The recognition of this and similar problems has resulted in numerous efforts to provide a safer outlet, and some of these efforts are illustrated in the following United States patents: U.S. Pat. No. 2,540,496 to Sperrazza; U.S. Pat. No. 2,826,652 to Piplack; U.S. Pat. No. 3,617,662 to Miller; U.S. Pat. No. 3,775,726 to Gress; U.S. Pat. No. 3,990,758 to Petterson; U.S. Pat. No. 4,148,536 to Petropoulsos et al.; U.S. Pat. No. 4,271,337 to Barkas; U.S. Pat. No. 5,320,545 to Brothers; U.S. Pat. No. 5,374,199 to Chung; U.S. Pat. No. 6,111,210 to Allison.

Conventional safety outlets employ a pair of contacts within the outlet housing that operate to close the electrical circuit when the plug blades or prongs are inserted into the outlet. These devices have a wire leading to each of the contacts, which are positioned near the prong apertures in the outlet, and the wires are in turn connected to a power source. Each contact is adjacent a switch that is generally an arm that extends across the outlet from the opposite aperture. For example, the switch arm for the hot contact extends from the neutral aperture across the outlet to the hot contact. Each switch arm has an angled surface at its respective aperture and a conductive surface attached at the end. When a plug blade (or similar object) is inserted into the respective aperture, each arm moves laterally to allow the conductive surface to engage the contact for the other aperture, thus supplying power to each aperture. Therefore, for power to be supplied to both female elements, blades must be inserted into both apertures. As will be recognized, insertion of a foreign object into one female element presents no danger because that insertion only energizes the other element into which nothing has been inserted. For a more complete description of such a system, see U.S. Pat. No. 4,271,337 to Barkas, the entire contents of which are herein incorporated by reference.

While this is clearly a valid concept insofar as safety is concerned, the structure of the conventional devices has certain disadvantages, largely associated with normal usage of the outlet. First, it can be seen that the devices generally, due to manufacturing cost benefits, have plastic arms for the switches. Therefore, when prongs from a plug are repeatably inserted into the electrical outlet, the metal prong wears away a portion of the plastic arm. Over the life of the outlet, the arm can be damaged to the point where the switch is no longer operational, shortening the life of the outlet. Second, the plastic surface can cause significant friction with the metal prong, making it difficult to operate the switch and thereby difficult to achieve the intended result of supplying electrical power to the intended device.

SUMMARY

Accordingly, it is an object of the present invention to provide an electrical receptacle having switched power circuits to reduce electrical shock hazard resulting from insertion of conductive foreign objects into the receptacle.

Another object of the present invention is to provide an electrical receptacle in which operating arms for the switches are laterally movable to expose the female conductive elements of the outlets by the plug blades, opening the switches before the blades engage the female elements.

A still further object of the present invention is to provide an electrical receptacle having a switch with low kinetic and static friction, for easy insertion of a plug and smooth responsive movement of the switch.

Yet another object of the present invention is to provide an electrical receptacle having a switch that is wear resistant for durability and increased outlet life.

These objects are basically obtained by an electrical receptacle for use with a power source, comprising a contact for making an electrical connection between the power source and a prong of an electrical plug, at least one switch being in series between the contact and the power source, and a resilient, smooth member covering at least a portion of the at least one switch, the switch being normally in the closed position and moving in a direction from the closed position to the open position due to a force applied to the resilient, smooth member covering at least a portion of the at least one switch by the prong of the electrical plug when the prong of the electrical plug is inserted into the electrical receptacle and contacts the resilient, smooth member.

Other objects, advantages and salient features of the invention will become apparent from the following detailed description which, taken in conjunction with the annexed drawings, disclose a preferred embodiment of the invention.

DETAILED DESCRIPTION OF THE PREFERRED EMBODIMENT

Figure 1:
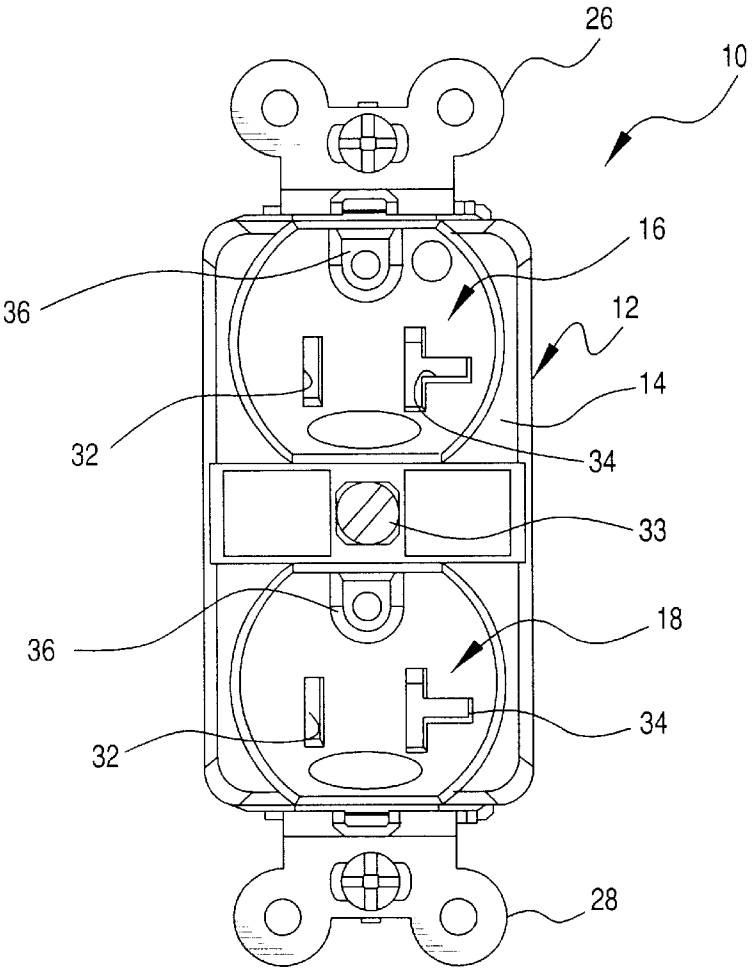
FIG. 1 is a front elevational view of a safety receptacle with jacketed internal switches according to the present invention.
Figure 2:
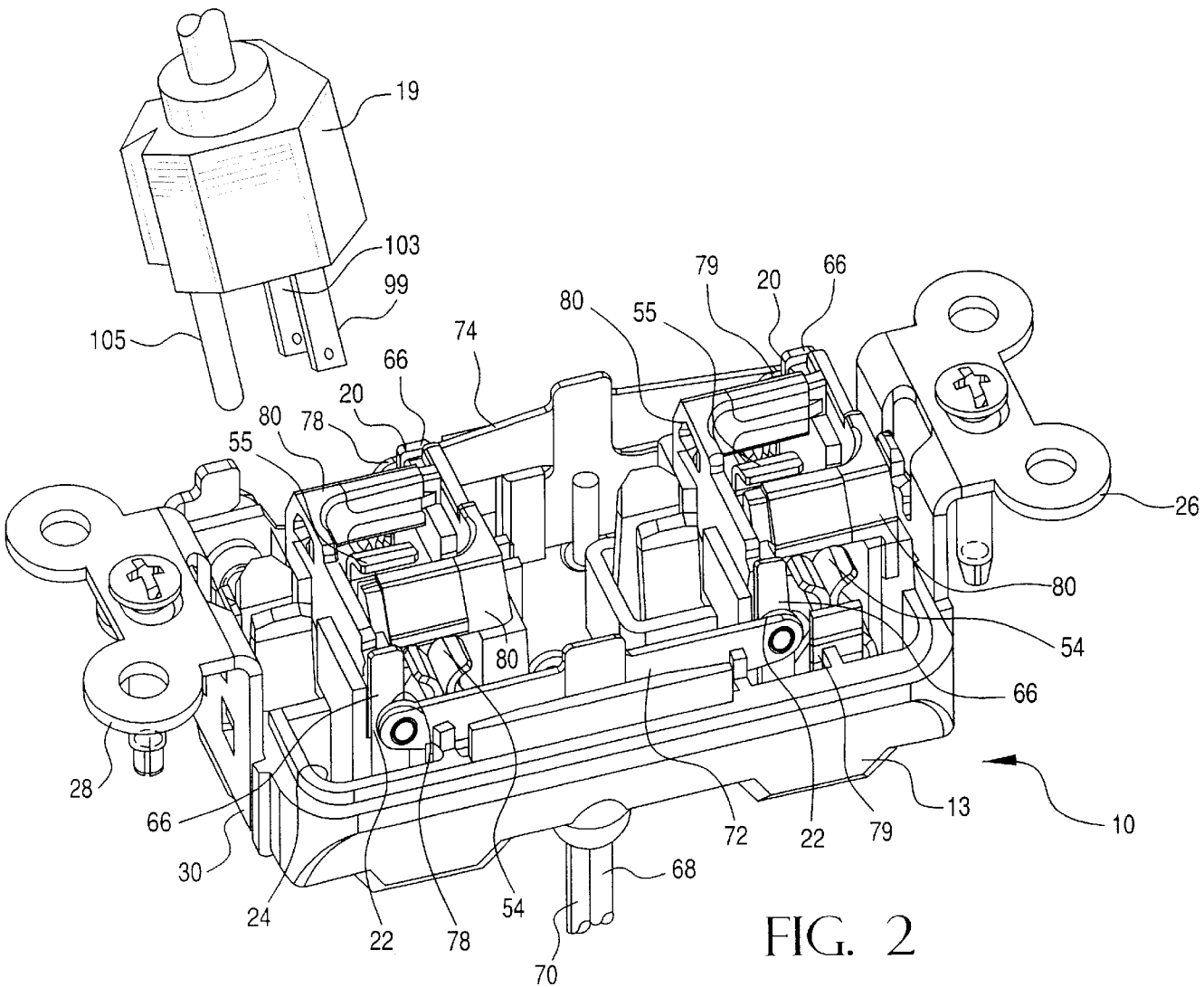
FIG. 2 is a side perspective view of the safety receptacle of FIG. 1 with the front housing portion removed and two plugs located adjacent thereto.

As seen in FIGS. 1 and 2, the safety receptacle 10 according to a preferred embodiment of the present invention, includes a housing 12 with a back portion 13 and a cover 14. The housing preferably contains two electrical receptacles or outlets 16 and 18 that each have two internal switches 20 and 22 that close the electrical circuit and allow electricity to flow from a power source (not shown) to the plug 19 that is inserted into the receptacle.

The housing back portion 13 is generally rectangular in shape, forming a hollow box having an open side 24, and is preferably molded using a heat and impact resistant thermoplastic material. As is conventional in such receptacles, longitudinally extending mounting tabs 26 and 28 protrude beyond the ends of the housing 12, the mounting tabs having openings to permit screws (not shown) to pass therethrough for mounting the receptacle in a conventional box. The tabs preferably constitute the end portions of a continuous metal strap member 30 which is bent so as to pass along the ends of the housing back portion 13 and along the back surface thereof, providing a continuous mounting and grounding member.

Figure 7:
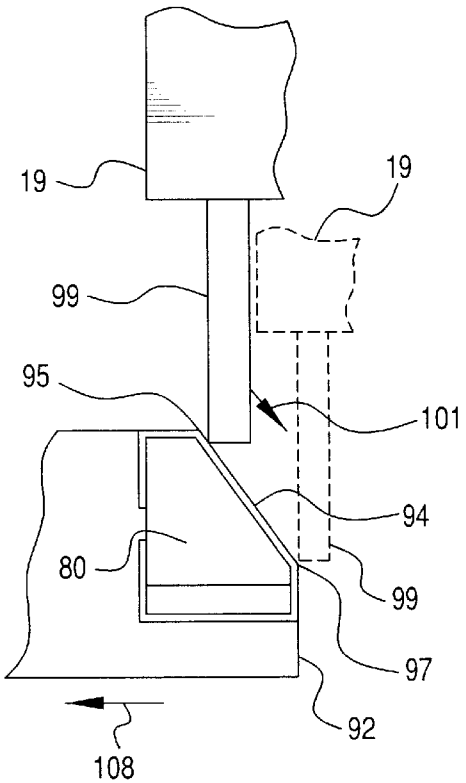
FIG. 7 is an end view of the movable arm and jacket of FIG. 6 showing a prong of an electrical plug traversing the cam surface of the jacket.

The cover 14 has openings suitably disposed to receive the prongs or blades 99 and 103 of a male plug 19 of conventional type to be used therewith as seen in FIGS. 2 and 7. In the specific receptacle illustrated, which is a duplex receptacle, at each end thereof are openings 32, and 34 to receive the blades which will form part of the power circuit for the appliance being connected to the receptacle and a third opening 36 to receive the ground prong 105 of a grounded three-prong connector. It will be observed that, in each case, opening 32 is rectangular in shape and opening 34 is T-shaped, opening 34 being designed to receive a blade which is either parallel to the blade that passes through opening 32, perpendicular thereto, or T-shaped. A plug in which the two blades that pass through openings 32 and 34 are parallel is referred to as a parallel blade plug, while a plug which has one blade to pass through opening 34 disposed in a plane perpendicular to that which passes through opening 32 will be referred to as an orthogonal blade plug. The ground prong 105 is normally D-shaped in cross-section, and is commonly longer than the blades that pass through openings 32 and 34. The cover is generally coupled to the housing back portion using screw 33, but can be coupled thereto using any method desired.

Figure 4:
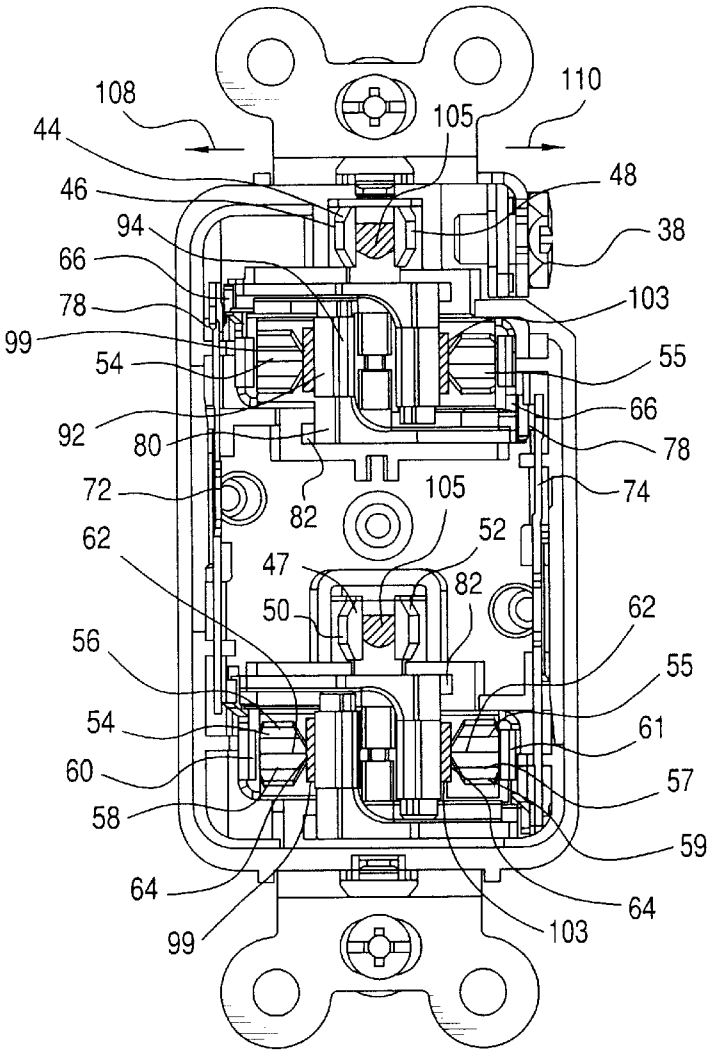
FIG. 4 is a front elevational view of the receptacle of FIG. 3 with the electrical contact switches in the closed position.
Figure 3:
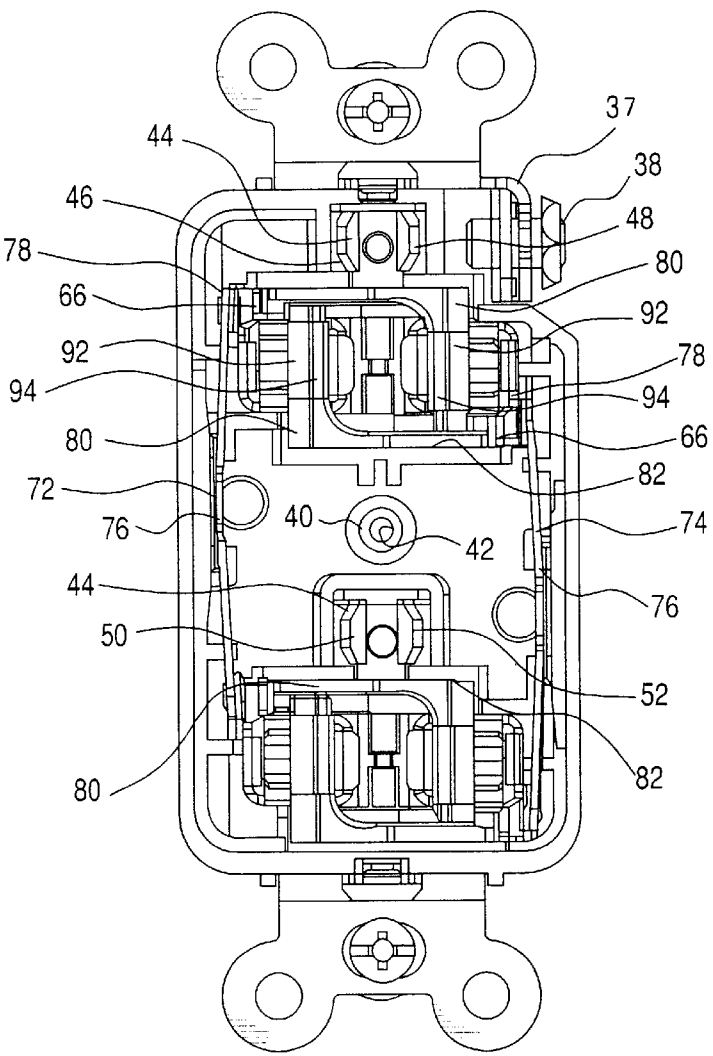
FIG. 3 is a front elevational view of the receptacle of FIG. 2 with the electrical contact switches in the open position.

In FIGS. 3 and 4, the housing back portion 13 can be seen with the cover 12 removed. It will be noticed in FIG. 3 that a grounding tab 37 is an integral part of the strap of which mounting tabs 26 and 28 are a part and that the grounding tab extends around the side of the receptacle, into a small rectangular recess formed at one corner of the housing, the tab 37 having an internally threaded opening to receive a screw 38 to which a ground wire can be connected.

Within the housing itself are two substantially identical sets of elements to form the electrical connections for receiving male plugs, and those elements in one portion of the housing will be referred to by the same reference numerals as those in the other portion of the housing. It will also be observed that the housing includes a central, integrally molded aperture 40 through which screw 33 passes to attach the cover onto the housing. Additionally, if desired aperture 40 can have a threaded metal sleeve 42 therein, to receive screw 33, sleeve 42 also passes through the back of the housing and is staked to a grounding/mounting strap that is coupled to tabs 26 and 28. Thus, the central screw is grounded. The grounding/mounting strap also includes members 44 bent into a U shape which protrude inwardly through the back of the housing and form female connector elements to receive the grounding prongs 105 of the male receptacle or plug, as is known in the prior art. As shown in FIG. 4, contact blade elements 46 and 48 form the grounding elements or members 44 while for the grounding element 47, the blades are identified as elements 50 and 52. In each case, the elements 46 and 48 and 50 and 52 are formed so that the elements include an inwardly convex surface to frictionally engage the grounding prong 105 inserted therein, the material used being sufficiently resilient metal so that sufficient contact is made and maintained even after repeated insertions.

As shown in FIGS. 2–4, outlets 16 and 18 are formed by two female connector elements or blades 54 and 55, one of which is the hot connection and the other the neutral connection. Each element 54 and 55 is formed from a piece of sheet metal that is cut and bent to form a generally rectangular, and nearly square, enclosure with three upwardly or outwardly extending contact blades 56, 58 and 60 and 57, 59 and 61, respectively. Since elements 54 and 55 are substantially similar only element 54 will be described herein. Blades 56 and 58 extend upwardly from opposite walls and blade 60 extends upwardly from the wall that is substantially perpendicular to and joins the walls from which blades 56 and 58 extend. Each blade extends upwardly and inwardly and then is bent outwardly again to form a U-shaped, resilient contact member. Blades 56 and 58 define a gap 62 between the innermost surfaces thereof to receive and frictionally engage a blade or prong from a plug therebetween. Blade 60 cooperates with the side edges of blades 56 and 58 to define a gap 64 into which a blade or prong can be inserted, gap 64 being perpendicular to gap 62. Outlets 16 and 18 also have an upwardly extending member 66 electrically and mechanically connected to each connector element 54. As seen in FIG. 2, member 66 forms one contact of each switch 20 and 22.

Switches 20 and 22 are basically formed by arms 80, which contact members 66 and conductive plates 72 and 74 that have contacts 68 and 70 at the ends thereof. The switches are in series between the power supply for the receptacle and the female elements 54. Thus, unless the switches are closed as shown in FIG. 4, no power will be transferred from the power supply to the elements 54.

More specifically, electrical power is supplied to the receptacle through wires 68 and 70 which pass through openings in the back wall of the receptacle provided for that purpose. The wires are insulated wires and the ends thereof are stripped and spot welded, or otherwise fixedly attached, to elongated electrically conductive plates 72 and 74, respectively. Plates 72 and 74 are generally T-shaped, having a depending portion which fits in slots 76 (FIG. 3), which are molded into an interior portion of the housing by which technique plates 72 and 74 are firmly located in its desired position generally parallel with one of the longer side walls of the housing.

It will further be observed from FIGS. 2–4 that contact elements 78 and 79 are provided at the opposite ends of plates 72 and 74, which form the other half of the switch of which members 66 constitute a half, the relationship of these being best seen in FIGS. 2–4. As will be observed from FIGS. 2 and 3, contacts 78 and 79 are normally spaced from the contacts 66 closest thereto, forming normally open switches, and the same is true for each of the other blades and contact arrangements.

Contacts 66 are preferably resilient, metal tabs that are adjacent arms 80. As described above, the contacts 66 are normally spaced from contacts 78 and 79 and therefore push the arms 80 back over the elements 54 when no pressure is applied thereto.

Figure 5:
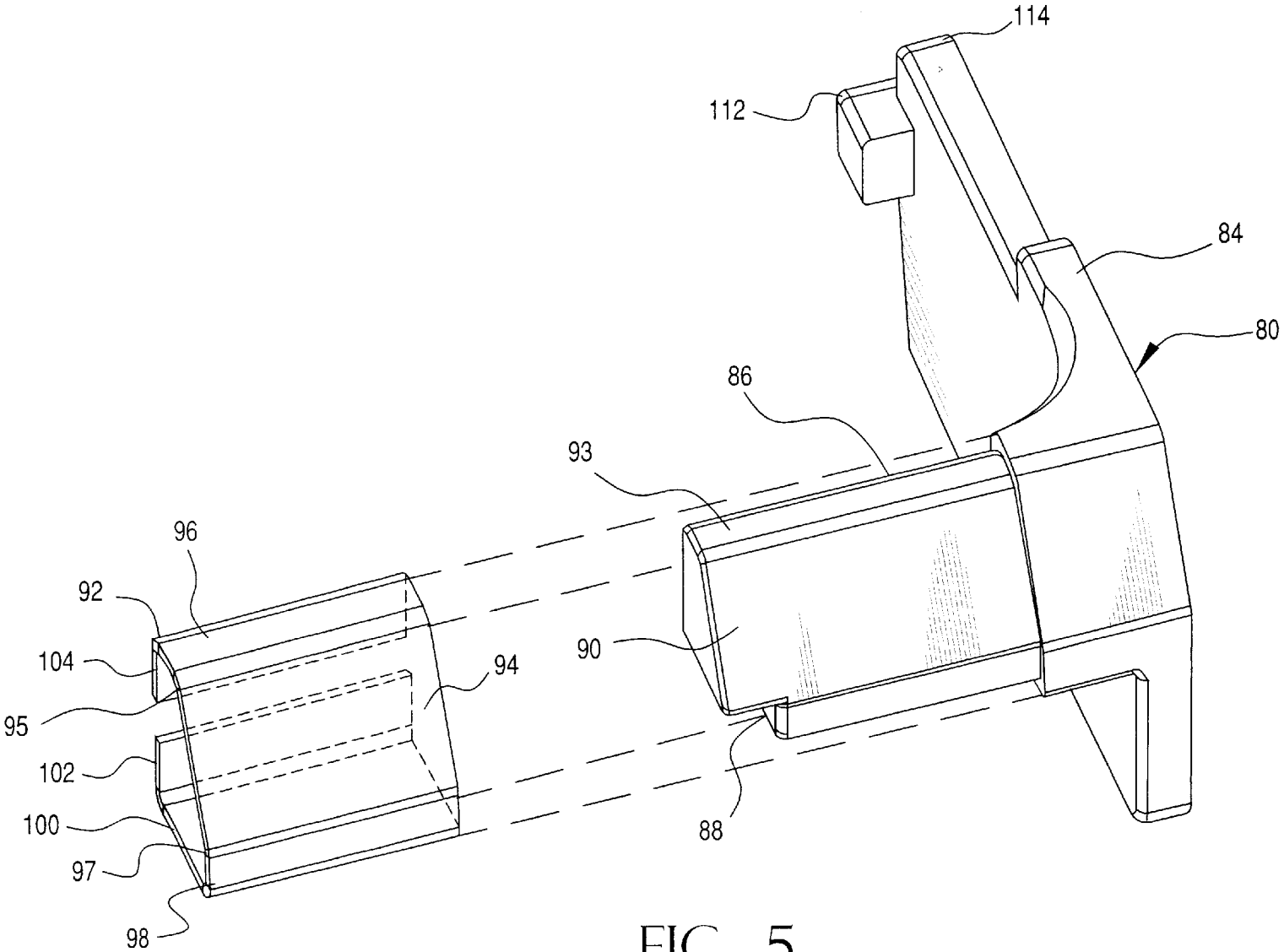
FIG. 5 is an exploded top perspective view of the movable arm of the electrical contact switch for the electrical receptacle of FIG. 4 and the metal jacket.

Arm 80 is preferably a generally L-shaped operating member and is inserted within a groove 82 that is defined by housing 13. It will be observed that each L-shaped operating arm has an elongated portion 84 and a perpendicular leg 86, as seen in FIG. 5. Elongated portion 84 fits into groove 82 and allows the arm 80 to slide back and forth (FIGS. 3 and 4). The leg 84 has a flat bottom surface portion and an L-shaped recess 88, the recess being provided so that leg 84 can pass partially over blade 60 of contact element 54 since blade 60 protrudes slightly upwardly above the upper limit of the recess in which element 54 fits.

As seen in FIG. 5, each leg 84 has an inclined cam surface 90, which is at an angle of about 55 degrees with the upper surface 93 of the operating arm. Leg portion 86 has a recessed portion 91 that extends adjacent the area where leg portion 86 connects with elongated portion 84 to the end of leg portion 86. It will further be observed from FIG. 7 that a metal jacket or sleeve 92 is coupled to at least a portion of leg 86, preferably extending along the recessed portion 91. The jacket 92 specifically covers the cam surface 90 from upper surface 93 to the bottom surface of the leg.

The jacket is preferably a metallic resilient material that is relatively resistant to wear and has a low coefficient of both static and kinetic friction and is formed in a substantially similar shape as the arm portion to which it is coupled. Suitable metals for this purpose are stainless steel or any other corrosion resistant material; however, these are only examples and the material maybe any material, metal or not, that is suitable for the purposes herein described. As seen in FIG. 5, the jacket has a cam surface 94, an upper surface 96, a front surface 98, a lower surface 100 and two rear surfaces 102 and 104. Surfaces 102 and 104 preferably extend substantially parallel and in substantially the same plane as one another. Each surface 102 and 104 extends from a corresponding surface toward each other and define a gap 106 therebetween. Gap 106 allows for easy fit and assembly of the metal jacket onto the arm 80.

More specifically, cam surface 94 has a first end 95 and a second end 97 and preferably extends at angle of about 55 degrees from upper surface 96 and extends to front surface 98. Front surface 98 is preferably substantially perpendicular to top surface 96 and therefore forms an angle of about 35 degrees with cam surface 94. Front surface 98 is substantially perpendicular with lower surface 100, which is in turn substantially perpendicular with rear surface 102 and 104. However, it should be noted that jacket 92 can be any suitable configuration that would result in the desired benefits of the present invention and should not be limited to the herein described structure.

Figure 6:
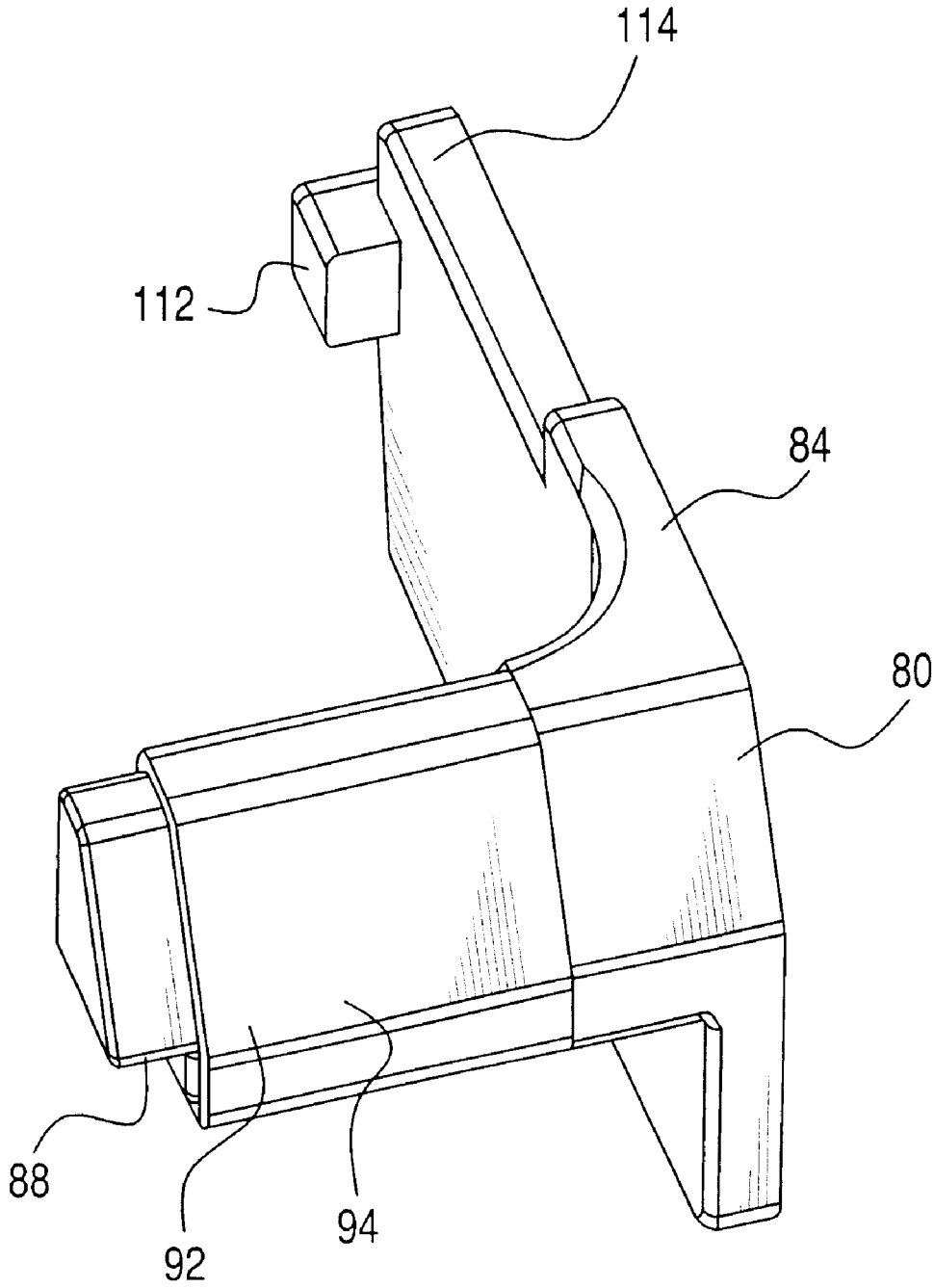
FIG. 6 is a top perspective of the movable arm of FIG. 5 with the metal jacket of FIG. 5 coupled thereto.

Preferably cam surface 94 overlies cam surface 90 and along with other surfaces of jacket 92 has a height that is about the same as the height of the recessed portion on leg portion 86. In other words, when jacket 92 is coupled to leg portion 86 the outer surface of the jacket, and in particular the outer surface of cam surface 94 is on about the same plane and substantially parallel to the non-recessed portion of the leg portion 86, as seen in FIG. 6.

Even though the jacket is preferably metal, as seen in FIGS. 2–4, no part of the jacket contacts the members 54 and as described above, arms 80 are preferably plastic, thereby insulating the metal jacket from the electrical source and isolating the jacket from conducting any electricity.

However, it is noted that the jacket does not necessarily need to substantially surround the leg portion 86 and may only cover the cam surface or a portion thereof. Furthermore, the jacket may be coupled to the cam surface or the leg portion in any manner desired, such as frictional engagement, adhesive, molded or embedded therein or any other suitable method.

Operation

Once the jackets 92 are placed onto the arms 80 and the arms are positioned in the receptacle, the receptacle housing can be coupled together and the receptacle is ready for use.

As seen in FIGS. 3, 4 and 7, the cam surfaces 90 and 94 of the arm and jacket, respectively, overlie one another and lie, in each case, at least partially over the gaps 62 in associated blades 54 and 55 so that plug blades or prongs 99 and 103 attempting to enter the gaps must engage the surface 94 of the jacket at an acute angle (FIG. 7). Engagement of a blade, or other element inserted with pressure or a force applied toward the contact element, must therefore act against cam surface 94, tending to move the operating member 80 in a direction indicated by arrows 108 and 110, in FIG. 4, overcoming the force applied by the contacts 66. The plug blades or prongs 99 and 103 will contact the cam surface of the jackets at an acute angle, as shown in FIG. 7, and will traverse the cam surface from first end 95 of the cam surface to second end 97 of cam surface 94, in the direction of arrow 101. Since cam surface of 94 is a smooth, metal surface and prongs for electrical plugs are generally metal, the friction between the prongs 99 and 103 and the cam surfaces is relatively low, facilitating insertion of the prong and movement of the arm. Furthermore, since surface 94 is metal, the surface resists wear and will last longer than conventional switches for safety receptacles.

Because elongated portion 84 is inserted in groove 82, the movement of arm 80 is constrained to this longitudinal movement. This movement causes protrusion 112 at end 114 of portion 84 to move and engage the contact 66 associated with the other blade 54 or 55 of the outlet. In other words, since the contacts 66 are resilient metal, the contact bends from the pressure applied by protrusion 112 and comes in contact with one of contacts 78 or 79 on plates 72 and 74. This constitutes the switch closing action. In other words, the switch that is open is on the opposite side of the receptacle from the female element toward which a prong or other body is being inserted. Thus, looking at FIG. 4, if a prong 99 is inserted toward the blade 54 closest to the grounding connector 38, the operating arm closest thereto will be moved to the left, closing the switch for blade 55. This energizes the left-hand female element, but not the right hand one. To energize both of the upper elements in that figure, blades would need to be inserted in or toward both of the female elements.

While one advantageous embodiment has been chosen to illustrate the invention, it will be understood by those skilled in the art that various changes and modifications can be made therein without departing from the scope of the invention as defined in the appended claims.

What is claimed is:

1. An electrical receptacle for use with a power source, comprising:

a contact for making an electrical connection between the power source and a prong of an electrical plug;

at least one switch being in series between said contact and the power source; and a smooth conductive member covering at least a portion of said at least one switch;

said switch being normally in the open position and moving in a direction from the open position to a closed position due to a force applied to said smooth member by the prong of the electrical plug when the prong of the electrical plug is inserted into the electrical receptacle and contacts said smooth member.

2. An electrical receptacle according to claim 1, wherein said smooth conductive member has a cam surface that allows the prong of the plug to apply said force and move said switch from said open position to said closed position.

3. An electrical receptacle according to claim 1, wherein a portion of said at least one switch is electrically non-conductive and substantially rigid.

4. An electrical receptacle according to claim 1, wherein a portion of said at least one switch is an arm that extends transverse to the direction of movement of said switch from the open position to the closed position.

5. An electrical receptacle according to claim 4, wherein said smooth conductive member is a jacket that extends substantially around the arm portion of the at least one switch.

6. An electrical receptacle according to claim 5, wherein said smooth conductive member is a jacket that is formed to substantially the same shape as the exterior surface of said at least one switch.

7. An electrical receptacle according to claim 1, further comprising at least two switches, each of said switches having a jacket covering at least a portion thereof.

8. An electrical receptacle according to claim 7, wherein each prong from said electrical plug contacts one of each of said jackets covering said at least two switches, which moves said switches in a direction from the open position to the closed position due to a force applied to each of said jackets by each of said prongs of the electrical plug when each of said prongs is inserted into the electrical receptacle and contacts each of said jackets.

9. An electrical receptacle according to claim 8, wherein each of said jackets is made of metal.

10. An electrical receptacle according to claim 8, wherein each of said jackets is formed to substantially the same shape as the exterior surface of its respective switch and extends substantially around its respective switch.

11. An electrical receptacle for use with a power source, comprising:

a first contact for making an electrical connection between the power source and a first prong of an electrical plug;

a second contact for making an electrical connection between the power source and a second prong of an electrical plug;

a first switch being in series between said first contact and said power source;

a second switch being in series between said second contact and said power source;

a first metal jacket covering at least a portion of said first switch; and a second metal jacket covering at least a portion of said second switch;

said first and second switches being normally in the open position and moving in a direction from the open position to a closed position due to forces applied to said first and second metal jackets covering at least a portion of said first and second switches by the first and second prongs of the electrical plug when the first and second prongs of the electrical plug are inserted into the electrical receptacle and contact said first and second metal jackets, respectively.

12. An electrical receptacle according to claim 11, wherein each of said metal jackets has a cam surface that allows the respective prong of the plug to apply said force and move said respective switch from said open position to said closed position.

13. An electrical receptacle according to claim 11, wherein a portion of said first and second switches are electrically non-conductive and substantially rigid.

14. An electrical receptacle according to claim 11, wherein a portion of said first and second switches are arms that extend transverse to the direction of movement from the open position to the closed position.

15. An electrical receptacle according to claim 14, wherein said first and second metal jackets extend substantially around the respective arm portion of said first and second switches.

16. An electrical receptacle according to claim 15, wherein said first and second jackets are formed to substantially the same shape as the exterior surface of said first and second switches, respectively.

17. A method for operating an electrical receptacle, the electrical receptacle having first and second female connector elements, a switch with a metal member covering at least a portion of the switch and having a first end and a second end, comprising the steps of inserting a plug having a prong into the electrical receptacle, the prong contacting the metal member adjacent the first end, applying a force to the prong in direction toward the metal member, the prong traversing the smooth member from the first end to the second end, moving the metal member as a result of the prong traversing the metal member from the first end to the second end laterally, and therefore the switch laterally and into contact with an electrical contact, the prong entering into the first female connector element, and closing the switch to provide power to the second female connector element.

18. A method according to claim 17, wherein the inserting step includes the prong contacting the metal member at an acute angle.

19. A method for operating an electrical receptacle, the electrical receptacle having first and second female connector elements, and first and second switches, each having first and second smooth members covering at least a portion of the first and second switches, respectively, and each smooth member having a first end and a second end, comprising the steps of inserting a plug having first and second prongs into the electrical receptacle, the first and second prongs contacting the first and second smooth members, respectively, adjacent the respective first end, applying a force to the first and second prongs toward the respective first and second smooth members, the first and second prongs traversing the respective smooth member from the first end to the second end, moving the first and second smooth members laterally as a result of the prongs traversing the first and second smooth members, and therefore the first and second switches laterally and into contact with a first and second electrical switch, respectively, the first prong entering the first female connector element and the second prong entering the second female connector element, and closing the first switch to provide power to the second female connector element, and closing the second switch provide power to the first female connector element.

20. An electrical receptacle for use with a power source, comprising:

a contact for making an electrical connection between the power source and a prong of an electrical plug;

at least one plastic switch being in series between said contact and the power source; and a metal jacket covering at least a portion of said at least one plastic switch;

said switch being normally in the open position and moving from the open position to a closed position due to a force applied to said metal jacket by the prong of the electrical plug when the prong of the electrical plug is inserted into the electrical receptacle and contacts said metal jacket, said metal jacket protecting said portion of said plastic switch from wear when the prong of the electrical plug forces said switch to the closed position.

21. An electrical receptacle according to claim 20, wherein said metal jacket has a cam surface that has a coefficient of friction less than the coefficient of friction of the plastic switch portion and that allows the prong of the plug to apply said force and move said switch from said open position to said closed position.

22. An electrical receptacle according to claim 20, wherein said portion is an arm; and said metal jacket extends substantially around said arm.

* * * * *